United States Patent [19]

Kodama et al.

[11] Patent Number: 4,535,734

[45] Date of Patent: Aug. 20, 1985

[54] SELF-CONTAINED HYDRAULIC LASH ADJUSTER

[75] Inventors: Hisashi Kodama, Nagoya; Tooru Hamamoto, Okazaki; Tetsuomi Tamura, Aichi; Katsujiro Sato; Kazuharu Yamada, both of Toyota, all of Japan

[73] Assignee: Aisin Seiki Kabushiki Kaisha, Kariya, Japan

[21] Appl. No.: 473,421

[22] Filed: Mar. 9, 1983

[30] Foreign Application Priority Data

Mar. 9, 1982 [JP] Japan ..... 57-32016[U]

[51] Int. Cl.[3] ..... F01L 1/24

[52] U.S. Cl. ..... 123/90.58; 123/90.55

[58] Field of Search ..... 123/90.55, 90.58, 90.59; 138/30; 137/539

[56] References Cited

U.S. PATENT DOCUMENTS

| | | | |
|---|---|---|---|
| 2,287,205 | 6/1942 | Stone | 137/539.5 |
| 2,896,663 | 7/1959 | Mena | 137/539.5 |
| 4,191,142 | 3/1980 | Kodama | 123/90.58 |
| 4,387,675 | 6/1983 | Hori et al. | 123/90.55 X |

*Primary Examiner*—Michael Koczo
*Assistant Examiner*—Peggy A. Neils
*Attorney, Agent, or Firm*—Sughrue, Mion, Zinn, Macpeak & Seas

[57] ABSTRACT

A self-contained hydraulic lash adjuster having a cup-shaped body and a plunger slidably disposed therein is further provided with a flexible diaphragm secured within a reservoir chamber located in the plunger with one side of said diaphragm being exposed to the atmosphere and the other side being disposed in engagement with the oil supply sealed within the hydraulic lash adjuster. An oil passage is provided in the bottom of the plunger to communicate the reservoir chamber with a pressure chamber defined between the bottom of the plunger and the bottom of the body and a one-way check valve is provided to prevent the return flow of oil through the oil passage to the reservoir. A cup-shaped cover member having apertured side walls is located in the bottom of the plunger over the oil passage to prevent the diaphragm from blocking the oil passage upon deformation of the diaphragm.

2 Claims, 3 Drawing Figures

SELF-CONTAINED HYDRAULIC LASH ADJUSTER

BACKGROUND OF THE INVENTION

The present invention is directed to hydraulic lash adjusters used in the valve trains of internal combustion engines and the like and more particularly to hydraulic lash adjusters of the self-contained type in which the fluid is sealed within the assembly with no provision for its replenishment from any external source during operation.

In the valve trains of internal engines a pre-determined valve clearance is generally provided in order to compensate for thermal expansion of various parts in the valve train and for frictional wear of the parts of the valve train mechanism. In order to keep the valve clearance in the zero state during the valve operation to thereby stabilize the valve operation, the self-contained hydraulic lash adjusters are slidably positioned between a cam upon the cam shaft and a push rod. Selfcontained hydraulic lash adjusters are generally comprised of a cup-shaped cylindrical body which is loosely fitted within a bore in the engine block. The body is provided with an upwardly open bore in which a plunger is slidably received to thereby define an oil reservoir and an oil pressure chamber within the body. The bottom wall of the plunger is provided with an oil passage having a one-way ball-type check valve associated therewith to allow only flow of fluid from the reservoir within the plunger to the pressure chamber which is located between the bottom of the plunger and the bottom of the body. Leakage clearance is provided between the body and the plunger and passages are provided in the sidewall of the plunger to provide for the return of oil from the pressure chamber to the reservoir when the fluid in the pressure chamber is pressurized. In some self-contained hydraulic lash adjusters, a flexible bag-shaped diaphragm of silicon rubber or the like is secured within the bore of the plunger to define the surface of the reservoir. The interior of the diaphragm is maintained in communication with the atmosphere by means of an air passage provided through a cap-like member located in the upper end of the bore of the body in contact with the upper end of the plunger.

Examples of such prior art lash adjusters are disclosed in the U.S. Pat. Nos. to Kodama, 4,191,142, granted Mar. 4, 1980; and 4,338,894, granted July 13, 1982, both of which are assigned to the assignee of the present application.

In the operation of such prior art lash adjusters the oil within the pressure chamber is returned to the reservoir chamber by means of the leakage clearance and oil passages in the side wall of the plunger when the valve is lifted while the oil within the reservoir is transmitted to the pressure chamber through the oil passage and one-way check valve located in the bottom of the plunger when the valve is returned. Thus, the volume of oil within the reservoir chamber repeatedly increases and decreases. In order to smoothly vary the oil volume, the diaphragm also repeatedly expands and contracts since the interior of the bag-like diaphragm is in communication with the atmosphere.

If the valve which is associated with such a lash adjuster is stopped in its lifted position when the engine is stopped, the lash adjuster will be subject to the biasing force of a spring through the rocker arm and push rod. Therefore, the plunger in the lash adjuster is forced downwardly and the oil within the pressure chamber continues to flow into the reservoir through the leakage clearance and the oil return passages. As a result, the diaphragm is gradually compressed to its completely compressed condition. Under these conditions it is possible that the lowermost end of the diaphragm will contact the bottom wall of the plunger surrounding the oil passage between the reservoir chamber and the pressure chamber and thus prevent the flow of oil from the reservoir chamber to the pressure chamber upon renewed operation of the engine. As a result, the self-contained lash adjuster will be inoperative. While such a problem can be avoided by increasing the distance between the lower end of the diaphragm in the totally compressed condition and the bottom wall of the plunger, it is preferable that the distance be reduced as small as possible in order to minimize the inertial mass of the lash adjuster to thereby improve the following movement of the valve with respect to the movement of the cam. Furthermore, it is desirable to have the overall axial range of the lash adjuster as small as possible to assist in the miniaturization of the engine per se.

SUMMARY OF THE INVENTION

The present invention provides a new and improved self-contained hydraulic lash adjuster which obviates the afore-mentioned problems associated with conventional self-contained hydraulic lash adjusters.

The present invention provides a new and improved self-contained hydraulic lash adjuster of the type having a flexible diaphragm located within a bore in the plunger wherein the diaphragm in its completely compressed condition is incapable of closing the oil passage in the bottom of the plunger when the engine is stopped.

The present invention provides a new and improved self-contained hydraulic lash adjuster which is capable of achieving the foregoing object while still remaining simple in construction and low in cost.

The present invention provides a new and improved self-contained hydraulic lash adjuster comprising a cup-shaped cylindrical body having a bore therein open at one end, a plunger having an oil reservoir chamber therein slidably disposed within said body and defining an oil pressure chamber between the bottom of said plunger and the bottom of said bore, an oil passage provided in said bottom of said plunger to provide fluid communication between said reservoir chamber and said pressure chamber, a check valve operatively associated with said oil passage for permitting oil flow in only one direction from said reservoir chamber to said pressure chamber through said oil passage, a flexible diaphragm secured within said reservoir chamber and cover means positioned in said reservoir chamber over said oil passage to prevent said oil passage from being closed by said diaphragm upon deformation of said diaphragm.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
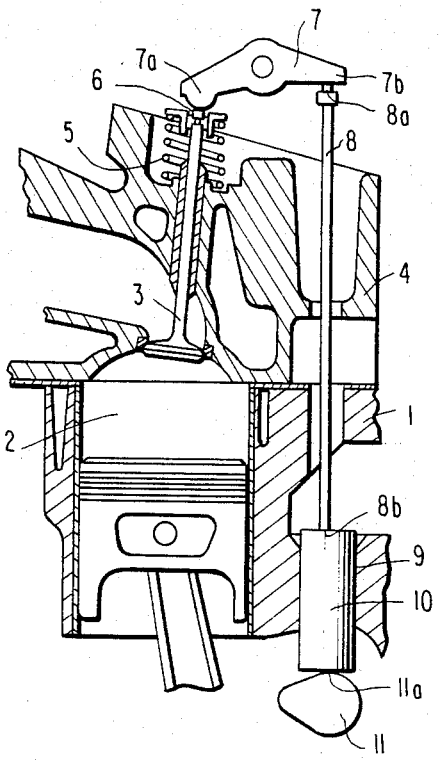
FIG. 1 is a transverse sectional view through a portion of an internal combustion engine having a valve operating train incorporating a self-contained hydraulic lash adjuster constructed in accordance with the present invention.

Referring now in detail to the drawings, there is shown in FIG. 1 an engine cylinder block 1 in which is located a working cylinder having a piston slidably mounted therein. A cylinder head 4 is secured to the top of the engine block 1 to define a combustion chamber 2 within the cylinder. The flow of gasses to and from the combustion chamber 2 is controlled by a pair of valves 3, one of which is shown in FIG. 1. The valve 3 is slidably supported by the cylinder head 4 with the upper end 6 thereof disposed in contact with one end 7*a* of a rocker arm 7. The other end 7*b* of the rocker arm 7 is disposed in contact with the upper end 8*a* of a pushrod 8. A self-contained hydraulic adjuster 10 is loosely and slidably fitted within a hole 9 in the engine block 1. The upper end of the lash adjuster 10 is operatively connected to the lower end 8*b* of the pushrod 8, while the lower end of the lash adjuster 10 is disposed in contact with the cam surface 11*a* of the cam shaft 11. The valve 3 is supported by the cylinder head 4 of the vehicle engine and is always biased upwardly by means of a spring 5. The self-contained hydraulic lash adjuster 10 moves up and down in response to the rotational movement of cam shaft 11 which is rotated by the crankshaft of the engine and the up and down movement of the lash adjuster 10 is transmitted to the rocker arm 7 by means of the pushrod 8. As a result, the valve 3 opens and closes.

Figure 2:
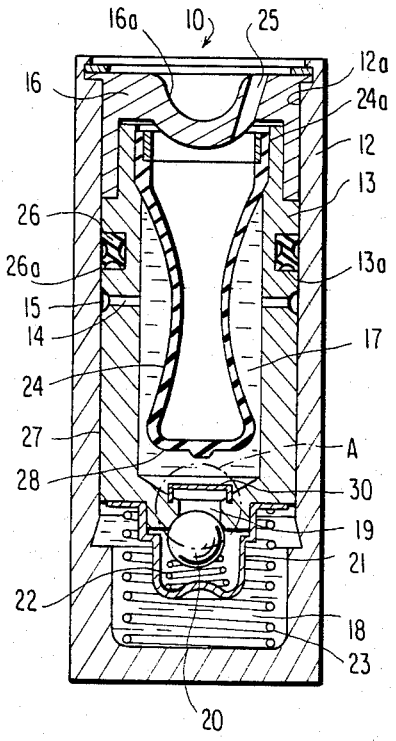
FIG. 2 is an enlarged longitudinal sectional view through the lash adjuster of FIG. 1 showing its internal construction in detail.

The details of lash adjuster 10 are best seen in FIG. 2 wherein the lash adjuster is comprised of a body 12 having an upwardly opening bore 12*a* in which a plunger 13 is slidably disposed. The plunger 13 is provided at an intermediate portion thereof with an annular oil return groove 15 and an oil return hole 14 disposed in communication with the groove 15. The cap 16 is positioned within the bore 12*a* and is comprised of an upper concave spherical surface 16*a* which is adapted to receive the lower convex spherical surface 8*b* of the pushrod 8 and a lower end which extends into engagement with the upper end of the plunger 13. Thus, the cap 16 is moveable within the bore 12*a* together with the plunger 13. A reservoir 17 is defined within the plunger 13 and a pressure chamber 18 is defined between the bottom wall of the plunger 13 and the bottom of the body 12. The bottom wall of the plunger 13 has an oil passage 19 for providing fluid communication between the reservoir 17 and the pressure chamber 18. A ball check valve 20 is disposed within the pressure chamber 18 and is normally biased into engagement with the passage 19 by means of a spring 22 which is supported by a retainer member 21. A spring 23 having a biasing force greater than that of the spring 22 is positioned within the pressure chamber 18 to hold the retainer 21 against the bottom surface of the plunger 13 and to normally bias the plunger 13 upwardly to the position shown in FIG. 2. The flexible bag-shaped diaphragm 24 is positioned within the upper portion of the reservoir 17 and the upper end portion 24*a* of the diaphragm 24 is securely positioned within an upper annular enlarged portion of the reservoir 17 within the plunger 13. The interior of the diaphragm 24 is maintained in communication with the atmosphere by means of a hole 25 formed in the cap 16. The portion 24*a* of the diaphragm 24 also functions to seal the oil within the reservoir 17. The flexible diaphragm 24 is always maintained in full contact with the fluid within the reservoir 17 and constantly changes with the volume of oil within the reservoir 17. An annular groove 13*a* is formed in the outer surface of the plunger 13 between the oil return groove and the lower end of the cap 16 and a sealing ring 26 having an X-configuration in cross section is positioned within the annular groove 13*a* to provide sealing contact at 26*a* with the body 12 to prevent the leakage of oil out of the lash adjuster. A silicon oil may be used as the working oil within the lash adjuster since changes in viscosity of silicon oil in response to changes in temperature are generally smaller. A leakage clearance 27 is provided between the inner surface of the body 12 and the outer surface of the plunger 13. The oil within the pressure chamber 18 is returned to the reservoir 17 by means of the leakage clearance 27, the annular groove 15 and the oil hole 14. The amount of oil present within the lash adjuster is sufficient to fully engage the diaphragm 24.

In operation, when the vehicle engine is started, the cam shaft 11 is rotated by means of the crank shaft and thus the body 12 of the lash adjuster 10 which is in engagement with the cam surface 11*a* is caused to be moved upwardly. As a result the load which is supplied to the cap 16 by means of the spring 5 increases and the oil pressure within the pressure chamber 18 is increased. The check valve 20 is maintained in its closed position under these circumstances and some of the oil within the pressure chamber 18 is returned to the reservoir 17 through the leakage clearance 27, the oil return groove 15 and the oil return 14 so that the diaphragm will be slightly compressed. Accordingly, the plunger 13 is moved downwardly within the body 12. When the cam shaft 11 is further rotated, the body 12 will move downwardly and the load which is supplied to the cap 16 by means of the spring 5 will be reduced to zero. The plunger 13 is now moved upwardly within the body 12 by means of the biasing force of the return spring 23. As a result, oil pressure within the pressure chamber 18 decreases and the check valve 20 will be moved away from the valve seat by the increase of pressure of the oil in the reservoir chamber against the biasing force of the spring 22. The oil within the reservoir 17 now flows into the pressure chamber 18. Since the interior of the diaphragm 24 is in communication with the atmosphere by means of the breathing hole 25, the diaphragm 24 expands in response to the reduced amount of oil in the reservoir 17. Thus, the lash adjuster 10 is returned to its original position. The expansion and contraction will be repeated during operation of the self-contained hydraulic lash adjuster 10.

When the valve clearance in the valve train mechanism is created due to the thermal expansion of the crank case cylinder and the like and the frictional wear of the valve train mechanism, the plunger 13 is moved upwardly relative to the body 12 by the return spring 23 so as to thereby keep the valve clearance in the zero state.

Since the number of lash adjusters in an engine equals the number of valves, eight lash adjusters will be provided in a four cylinder engine. During operation of the engine, air will be continuously transferred through the breathing holes 25 into and out of the diaphragms 24 in response to changes in the oil volume within the reservoir 17 so that the diaphragm repeatedly expands and contracts. Under these conditions the deformation to the diaphragm 24 will not become extremely large so that a sufficient gap will always be maintained between the lower portion 28 of the diaphragm 24 and the bottom surface of the plunger 13. When the engine is stopped, at least some of the eight lash adjusters will be stopped in their valve lifting condition. Under these conditions, the nose portion of the cam surface 11*a* of the cam shaft 11 is brought into engagement with the bottom of the lash adjuster 10 so as to lift the lash adjuster 10 and the biasing force of the spring 5 is transmitted to the plunger 13 through the rocker arm 7, pushrod 8, and cap 16. Therefore, the oil within the pressure chamber 18 flows out into the reservoir 17 through the leakage clearance 27, the oil return groove 15, and the oil return hole 14. The diaphragm 24 may now be completely compressed and there is a possibility that the lower portion of the diaphragm 24 will be brought into full contact with the bottom 29 of the plunger 13 so as to effectively close the oil passage 29.

Figure 3:
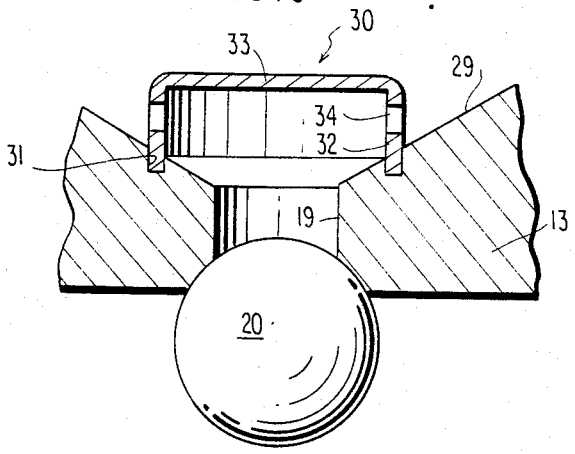
FIG. 3 is an enlarged sectional view of the circled portion A of FIG. 2.

In order to prevent such an occurence a cover 30, as best seen in FIG. 3, is provided over the end of the oil passage 19 within the reservoir chamber 17. The bottom 29 of a plunger 13 is provided with an annular slot 31 in which the inverted cup-shaped cover 30 is fitted. Alternatively, the cover 30 may be positioned within the oil passage 19. The cover 30 is provided with a cylindrical side wall 32 and a plain disc-shaped top. A plurality of oil transmission holes 34 are formed in the side wall 32 for the free passage of oil therethrough. The top surface of the top wall 33 is preferably smooth so that the diaphragm 24 will not be damaged by contact with the cover 30, even when the diaphragm 24 is made of a soft material such as silicon rubber. The configuration of the cover 30 may be modified as long as the cover prevents the oil passage 19 from being closed by the diaphragm 24. The cover 30 may be secured to the plunger by any suitable means such as welding and the like.

Although the invention has been particularly shown and described with reference to a preferred embodiment thereof, it will be understood by those in the art that various changes in form and detail may be made therein without departing from the spirit and scope of the invention.

What is claimed is:

1. A self-contained hydraulic lash adjuster comprising a cup-shaped cylindrical body having a bore therein open at one end, a plunger having an oil reservoire chamber therein slidably disposed within said body, and defining an oil pressure chamber between the bottom of said plunger and the bottom of said bore, an oil passage provided in said bottom of said plunger to provide fluid communication between said reservoir chamber and said pressure chamber, a check valve operatively associated with said oil passage for permitting oil flow in only one direction from said reservoir chamber to said pressure chamber through said oil passage, a flexible diaphragm secured within said reservoir chamber and a cover means positioned in said reservoir chamber over said oil passage to prevent said oil passage from being closed by said diaphragm upon deformation of said diaphragm wherein said cover means is comprised of a cup-shaped member having an apertured side wall in engagement with said bottom of said plunger and a flat end wall spaced above said oil passage in said bottom of said plunger.

2. A self-contained hydraulic lash adjuster as set forth in claim 1 further comprising an annular groove in said bottom of said plunger within said reservoir surrounding said oil passage with said apertured wall of said cover means being secured therein.

* * * * *